US007299885B2

(12) United States Patent
Baird

(10) Patent No.: US 7,299,885 B2
(45) Date of Patent: Nov. 27, 2007

(54) DOWNHOLE DRILL STRING HAVING A COLLAPSIBLE SUBASSEMBLY AND METHOD OF LOOSENING A STUCK DRILLSTRING

(76) Inventor: Jeffery D. Baird, P.O. Box 769, Breckenridge, TX (US) 76424

( * ) Notice: Subject to any disclaimer, the term of this patent is extended or adjusted under 35 U.S.C. 154(b) by 205 days.

(21) Appl. No.: 10/521,346

(22) PCT Filed: Jul. 10, 2003

(86) PCT No.: PCT/US03/21537

§ 371 (c)(1),
(2), (4) Date: Jan. 10, 2005

(87) PCT Pub. No.: WO2004/005668

PCT Pub. Date: Jan. 15, 2004

(65) Prior Publication Data

US 2005/0230154 A1 Oct. 20, 2005

Related U.S. Application Data

(60) Provisional application No. 60/395,739, filed on Jul. 10, 2002.

(51) Int. Cl.
*E21B 31/107* (2006.01)

(52) U.S. Cl. ..... 175/57; 175/305; 175/300; 175/321; 175/325.3; 166/301

(58) Field of Classification Search ..... 175/57, 175/256, 293, 294, 305, 306, 300, 321, 322, 175/301, 325.3; 166/117.7, 301
See application file for complete search history.

(56) References Cited

U.S. PATENT DOCUMENTS 4,842,082 A * 6/1989 Springer ..... 175/321
5,931,239 A * 8/1999 Schuh ..... 175/325.3
6,082,457 A * 7/2000 Best et al. ..... 166/301

* cited by examiner

*Primary Examiner*—Lanna Mai
*Assistant Examiner*—Matthew J. Smith
(74) *Attorney, Agent, or Firm*—Jackson Walker, LLP

(57) ABSTRACT

A method and apparatus for allowing a downhole drill string to be stuck at one location and continue to rotate above the stuck section. The apparatus provides a method for collapsing the stuck subassembly by reducing its outside diameter. Simultaneous with the subassembly collapse, a jarring action is initiated from within the drill string to further loosen the stuck sections. At the same time drilling fluid inside the string is allowed to circulate outside the string through a circulation sub. The fluid is forced around the stuck subassembly further increasing the likelihood that the subassembly will be freed.

11 Claims, 9 Drawing Sheets

FIG.3A
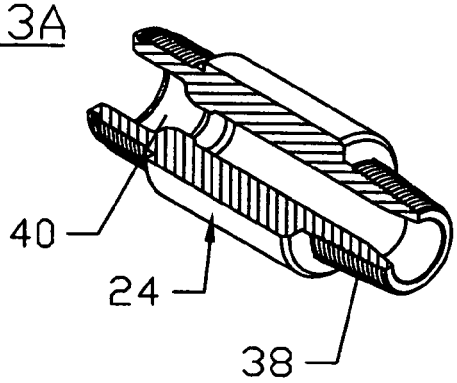
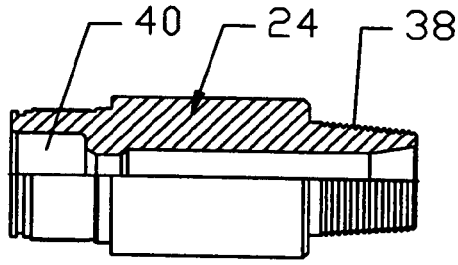
FIG.3B
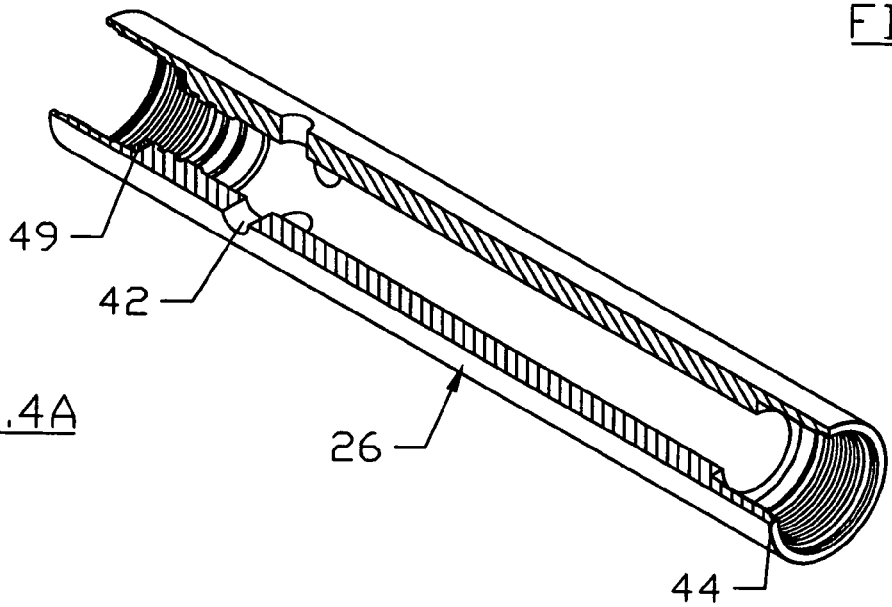
FIG.4A
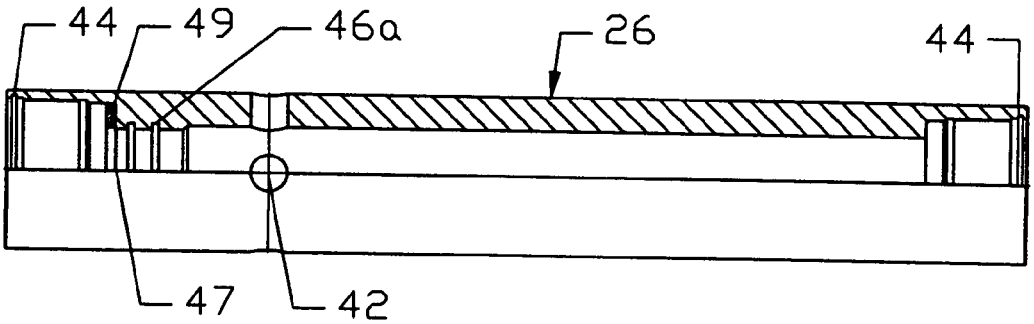
FIG.4B

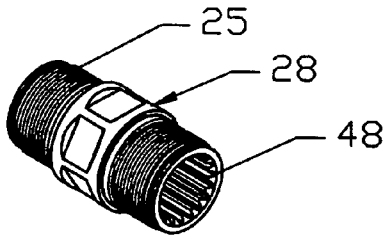
FIG.5
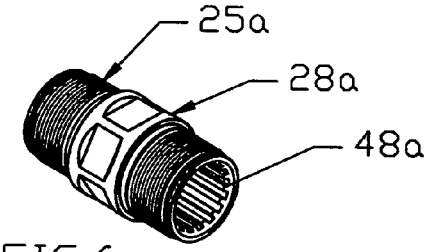
FIG.6
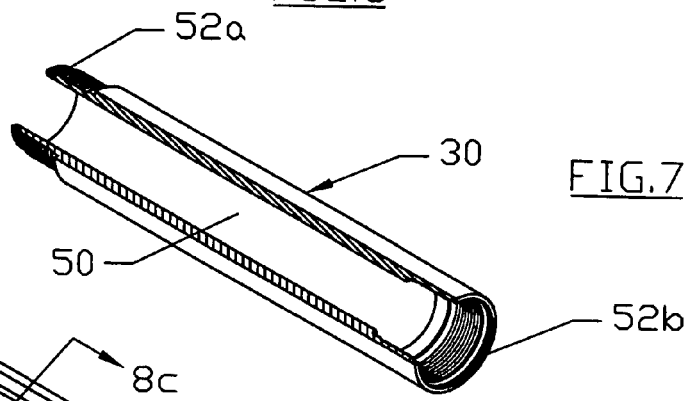
FIG.7
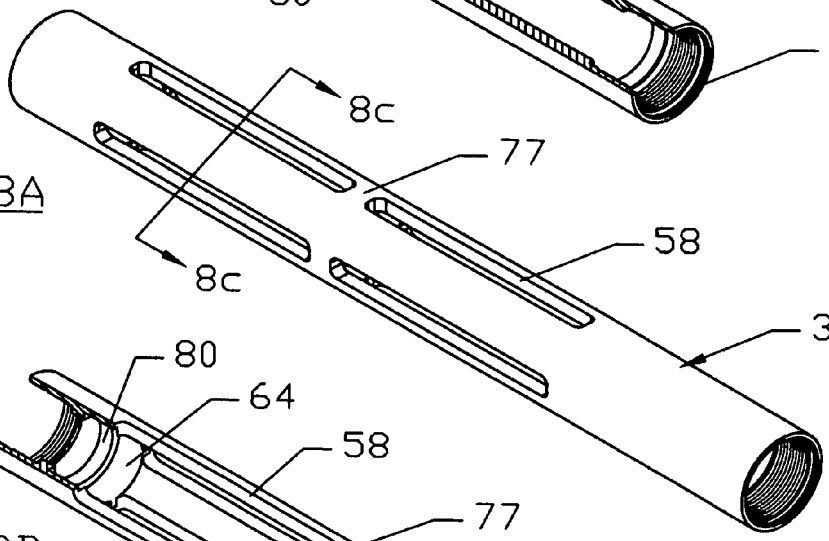
FIG.8A
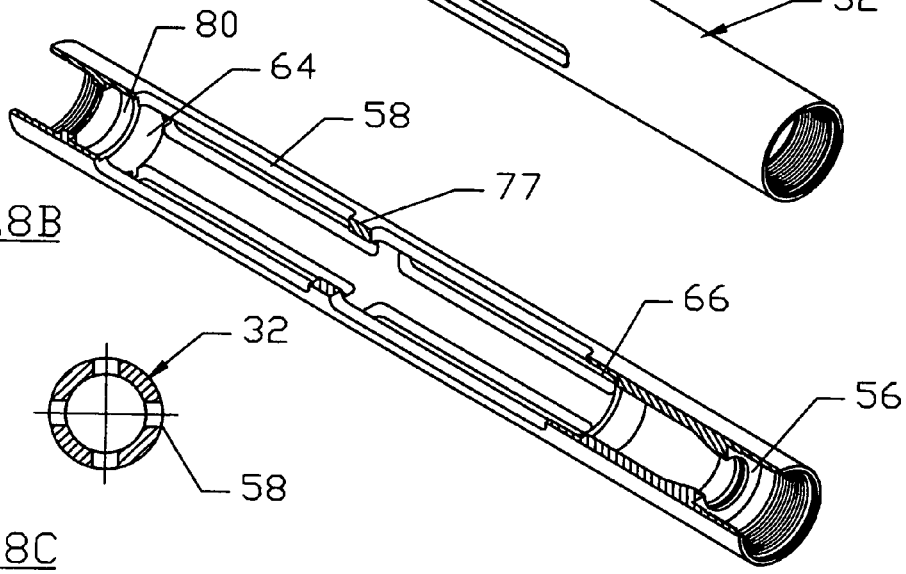
FIG.8B
FIG.8C

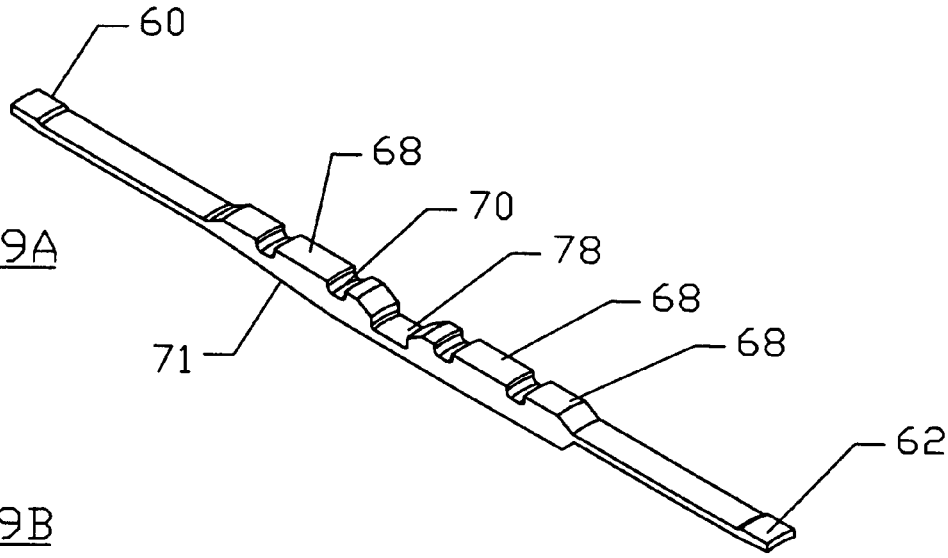
FIG.9A
FIG.9B
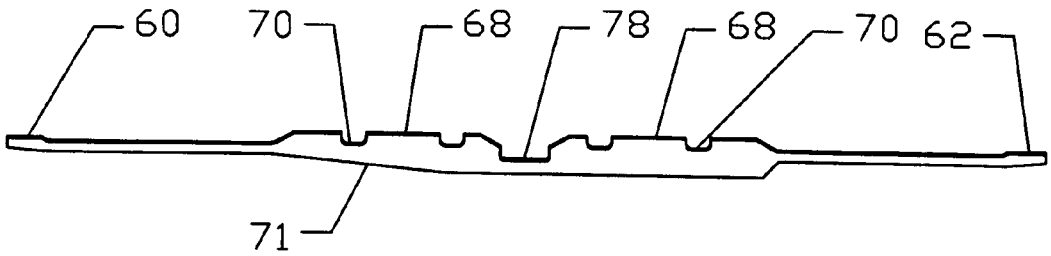
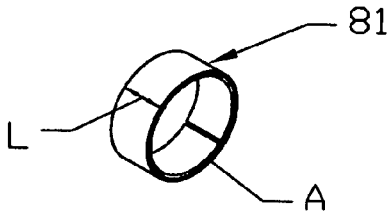
FIG.10A
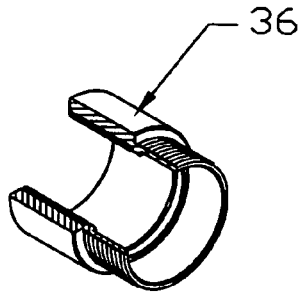
FIG.11
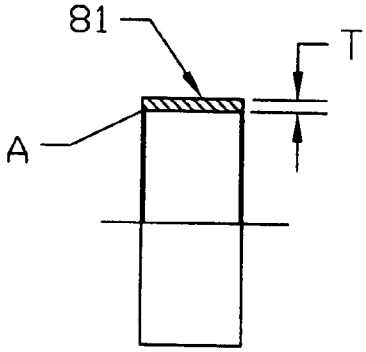
FIG.10B

DOWNHOLE DRILL STRING HAVING A COLLAPSIBLE SUBASSEMBLY AND METHOD OF LOOSENING A STUCK DRILLSTRING

This application claims priority to pending U.S. Provisional Patent Application No. 60/395,739 filed Jul. 10, 2002.

BACKGROUND OF THE INVENTION

The present invention relates to an apparatus and method for loosening a stuck section of a downhole drill string within a well borehole. More particularly, but not by way of limitation, the present invention relates to collapsing a subassembly along a section of a rotatable drill string to reduce the subassembly's outside diameter while at the same time initiating within the string a jarring action or force that resonates along the entire drill string and simultaneously allowing drilling fluid inside the drill string to circulate to the outside of the string within the well borehole. All of the structural features and actions of the present invention cooperate to collapse a sub-section of the drill string allowing upstream sections to continue to rotate within the borehole. The collapsing subassembly may be a drilling stablizer, a reamer, or even a casing scraper. In some applications, the collapsing subassembly need not be stuck to activate the natural jarring actions and the circulating features of the present invention.

A drill string is used to drill a subterranean well bore. The drill string typically consists of multiple joints of drill pipe, drill collars, and a drill bit. To facilitate completion of the well, it is important that deviation from vertical be controlled. In the past, deviation of the well bore has been controlled by the manipulation of the string weight on the drill bit or directional control tools, such as mud motors and monel collars. The length, weight, and outside diameter of the drill collars help maintain stabilization while applying a sufficient amount of weight on the bit to affect bit penetration. However, too much weight on the bit may result in hole deviation problems.

Additional equipment has been used to stabilize the drill string. These devices are commonly known as stabilizers. These tools have a larger outside diameter than the drill collars and are in constant rotational contact with the sidewall of the well bore during the drilling process. The problem with stabilizers is that the contact between the stabilizer and the well bore can be the source of many problems. For example, penetrated, soft formations may collapse or swell inwardly after penetration of the bit which may in turn cause the stabilizer to become stuck. In addition, water loss in some formations may cause excessive mud cake buildup on the wall of the well bore which can also cause sticking to occur.

There are times when other subassemblies other than stabilizers get stuck, slowing or stopping the drilling process. Sometimes reamers which are cutting a larger bore above the drill bit bore become lodged in the walls of the formation. Occasionally, a casing scraper used to clean an in place casing run also becomes stuck within the casing. These problems are tremendously costly to correct with current technology. Often the drill string must be left downhole and the well bore redrilled.

Further, if a subassembly does become stuck, this can lead to the drill string becoming stuck in several additional locations along the string if rotation of the drill string and circulation of drilling fluid is not maintained. The present invention allows the stuck subassembly to cease rotating while the sections above the stuck one continue to rotate. Further, it may be difficult to free the drill string from being stuck if the point of sticking is not known, and the process of determining the sticking point is expensive and time consuming.

To this end, a need exists for a subassembly that is capable of being selectively collapsed to reduce its outside diameter if the sub becomes stuck thereby possibly eliminating the point of sticking. A need further exists for a drill string that is capable of maintaining circulation and rotation above the point of sticking to prevent further sticking of the drill string. Further, there is a need to be able to jar the string internally when stuck, and to be able to locate where along the string the subassembly is stuck. It is to such an apparatus that the present invention is directed.

BRIEF DESCRIPTION OF THE DRAWINGS

FIG. 3A is a partial, cutaway, isometric view of a bit crossover. FIG. 3B is an elevational view, partially in cross section, of the bit crossover.

FIG. 4A is a cutaway, isometric view of a circulating sub. FIG. 4B is an elevational view, partially in cross section, of the circulating sub.

FIG. 5 is an isometric view of a spline housing.

FIG. 6 is an isometric view of another embodiment of a spline housing.

FIG. 7 is a cutaway, isometric view of a spacer housing.

FIG. 8A is an isometric view of a leaf barrel. FIG. 8B is a cutaway, isometric view of the leaf barrel. FIG. 8C is a cross-sectional view taken along line 8C-8C of FIG. 8A.

FIG. 9A is an isometric view of a centralizing leaf. FIG. 9B is a side elevation view of one of the centralizing leaves.

FIG. 10A is an isometric view of a trip ring. FIG. 10B is an elevational view, partially in cross section, of the trip ring.

FIG. 11 is a cutaway, isometric view of a trip ring retainer.

DETAILED DESCRIPTION OF THE INVENTION

Figure 1A:
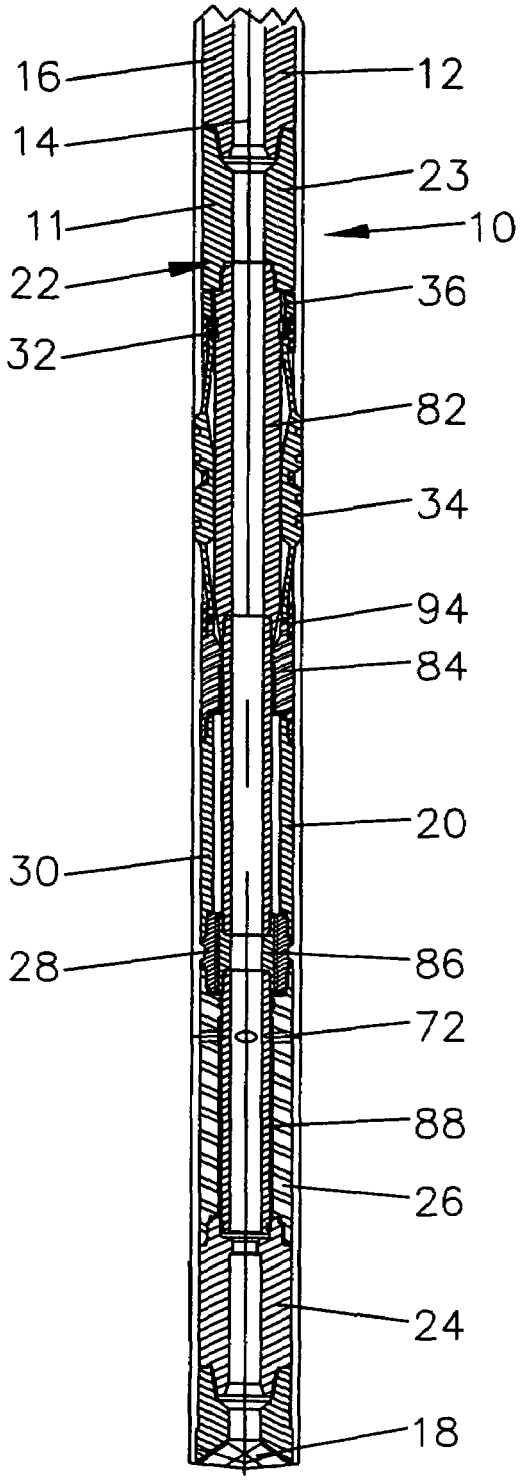
FIG. 1A is an elevational view, partly in cross section, showing a drill string constructed in accordance with the present invention installed in a well bore in a drilling position with an upstream pipe section attached to the subassembly and showing a bit.
Figure 2A:
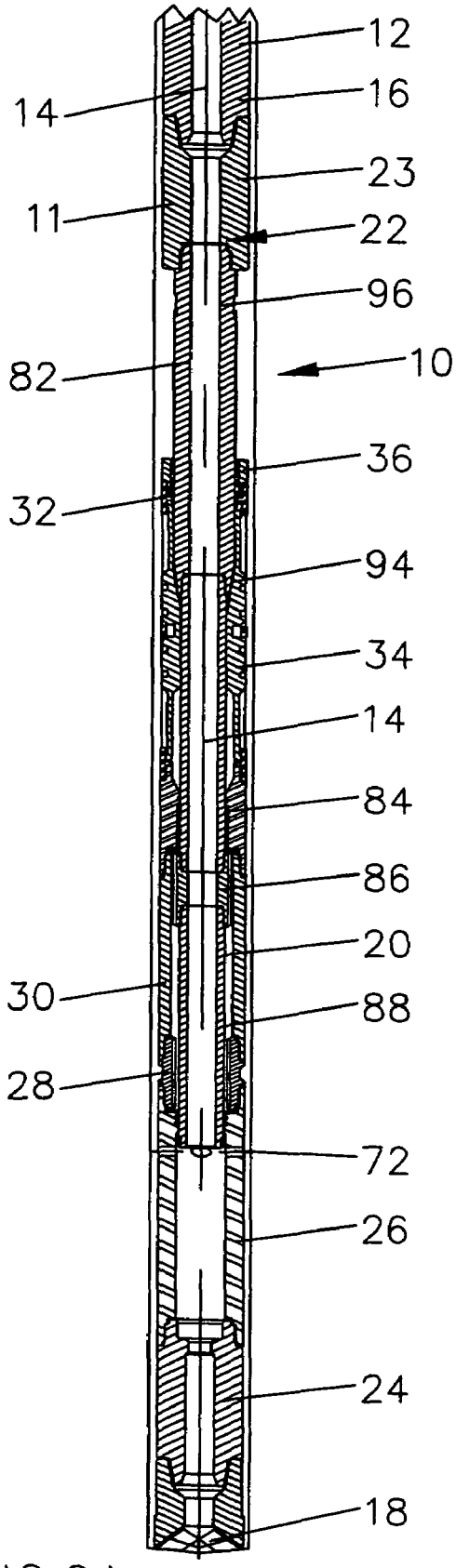
FIG. 2A illustrates an elevational view, partly in cross section, showing the drill string in the released position with the drill string left off the bottom of the well bore.

Referring to FIGS. 1A and 2A, a portion of a drill string 10 constructed in accordance with the present invention, is shown incorporated in an overall drill string 12 located downhole within a well bore hole 14. Although a single section 10 is illustrated as being attached to the string 12 between drill collar 16 and drill bit 18, it should be understood that single or multiple sections may be attached to the string 12 as discussed below.

FIG. 1A illustrates the string 12 in a drilling mode with the weight of the drill string 12 applied to the bit 18 and the entire string 12 being rotated by a drilling rig (not shown) or the bit 18 may be independently rotated by a mud motor. In the drilling mode, a collapsing subassembly 11 engages the side wall of the well bore 14 to maintain a substantially vertical orientation. In FIG. 1A, the subassembly 11 is a stabilizer wherein leaves 34 are extended against the sidewall. As previously stated, the leaves 34 may be replaced by a reamer or scraper mechanism.

FIG. 2A shows the string 12 in a non-drilling mode wherein the subassembly 11 has been tripped, the leaves 34 have collapsed to a release position away from the sidewalls, and the subassembly longitudinal extended initiating an internal jarring action within the drill string and circulation of drilling fluid via holes 72 from inside the subassembly 11 to outside the subassembly and into the well bore hole, and allowing for continued rotation of the drill string sections above the tripped subassembly.

The subassembly 11 includes a housing assembly 20 and a mandrel assembly 22 that is adapted for telescopic movement relative to the housing assembly 20. The housing assembly 20 includes a bit crossover 24, a circulating sub 26, a spline housing 28, a spacer housing 30, a leaf barrel 32, a plurality of centralizing leaves 34, and a trip ring retainer 36. The mandrel assembly 22 includes a mandrel top sub 23, centralizing mandrel 82, a spacer mandrel 84, a spline mandrel 86, and a stinger 88.

Figure 1B:
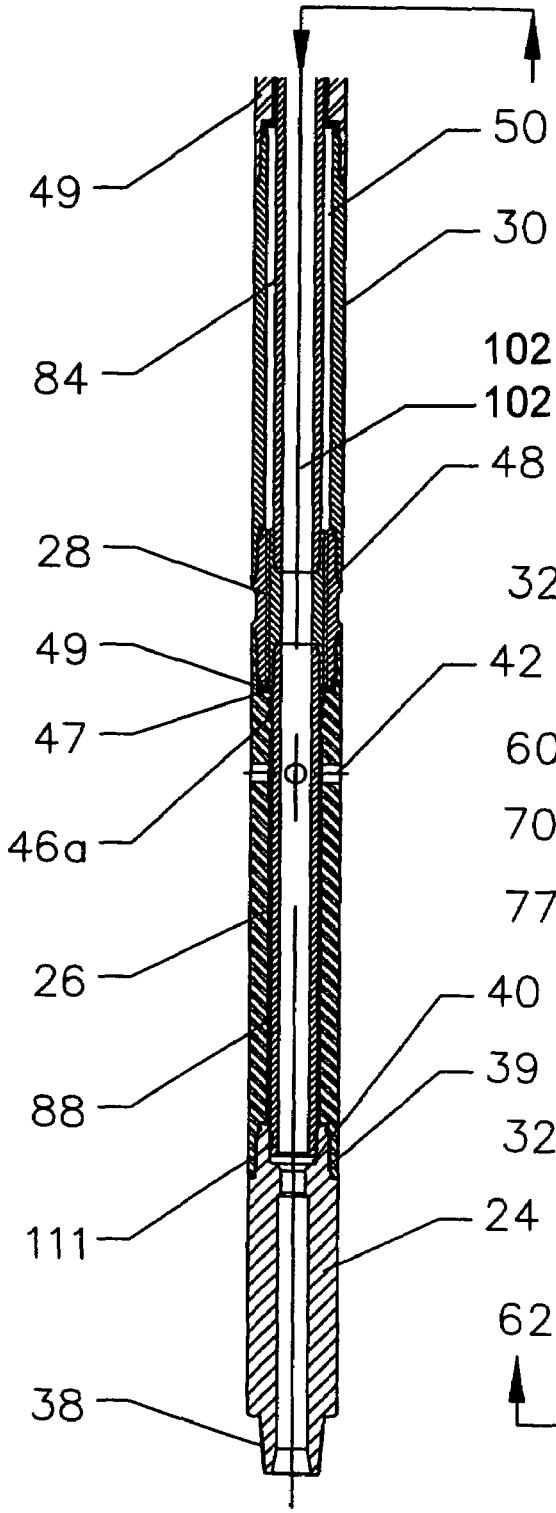
FIG. 1B shows a lower portion of the subassembly of the present invention in the drilling mode from the bit crossover section to above the spacer mandrel without showing a bit or the well bore.
Figure 1C:
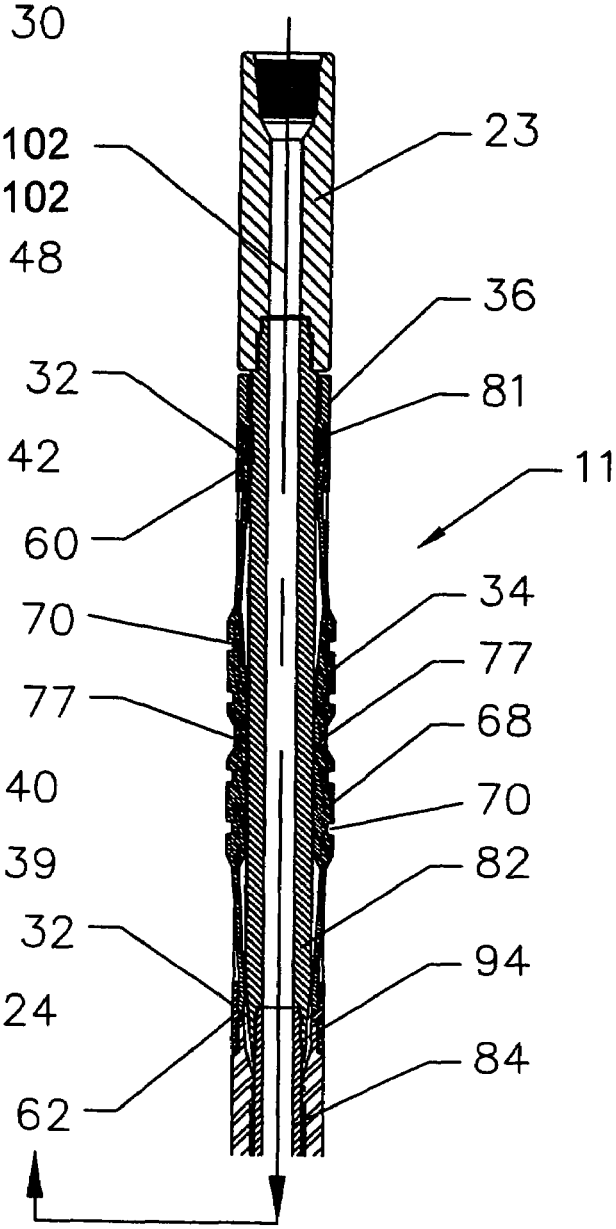
FIG. 1C shows an upper portion of the subassembly of the present invention in the drilling mode from the leaf barrel to the mandrel top sub without showing the upstream drill string section on the well bore.

Turning to FIGS. 1B and 1C, the bit crossover 24 has an external threaded portion 38 for connection with the drill bit 18 or another member of the drill string 12, such as a drill collar. The crossover 24 is provided with an annular recess 40 for receiving the stinger 88 portion of the mandrel assembly 22, as discussed below, and a second threaded portion 39 for connection with the circulating sub 26. Additionally, it should be understood that the bit crossover 24 may be provided with a plurality of circulating parts (not shown) and a sliding sleeve activated by a drop bar to facilitate circulation of drilling fluid without the need to move the subassembly 11 to the released position.

The circulating sub (FIGS. 4A and 4B) is provided with a plurality of holes 42 to permit the release of drilling fluid when the subassembly 11 is in the released condition. The holes 42 may be provided with accessories, such as check valves or tungsten inserts. The circulating sub 26 is further provided with a plurality of annular grooves 44 for receiving an O-ring and a pair of grooves 46*a* for receiving seal members, such as a polypak type seal. The upper end of the circulating sub 26 is provided with an internal shoulder 47 for supporting a jarring wear ring 49. The upper end of the circulating sub 26 is connected to the spline housing 28.

The spline housing 28 is provided with a plurality of involute splines or teeth 48 extending longitudinally along the interior surface of the spline housing 28 as shown in FIG. 5. The upper end 25 is connected to the spacer housing 30. FIG. 6 illustrates another embodiment of a spline housing 28*a* having a plurality of equi-spaced splines or teeth 48*a*. The upper end 25*a* of the spline housing is connected to the spacer housing 30.

As shown in FIG. 7, the spacer housing 30 is an elongated tubular member having a bore 50. Each end of the spacer housing 30 is provided with an annular groove 52*a* and 52*b* for receiving an O-ring. The upper end of the spacer housing 30 is connected to the leaf barrel 32.

As shown in FIGS. 8A through 8C, the leaf barrel 32 is provided with an internal shoulder 56 for supporting another wear ring 49 (see FIG. 4B). The upper end of the leaf barrel 32 is provided with an annular recess 80 for receiving a trip ring 81 (FIG. 10A). The leaf barrel 32 further includes a plurality of elongated slots 58 spaced circumferentially about the leaf barrel 32. The slots 58 are adapted to receive one of the centralizing leafs 34 so that the centralizing leaves 34 are moveable through the slots 58 in a radial outward and inward direction, as will be discussed in greater detail below. The slots 58 are interrupted at medial locations by one or more bridges 77.

As shown in FIGS. 9A and 9B, each of the centralizing leaves 34 has a first end portion 60 and a second end portion 62 which are adapted to be disposed in corresponding recesses 64 and 66 of the leaf barrel 32 (FIG. 8B). Each centralizing leaf 34 is provided with a wall engaging portion 68 which is formed at a medial portion of the leaf 34. The external side of the wall engaging portion 68 is provided with a plurality of arcuate shaped grooves 70 to facilitate sliding engagement with the sidewall of the well bore 14 and permit fluid passage. It will be understood that the size and shape of the wall engaging portion 68 of the leaf 34 may be formed in a variety of shapes depending on the functional requirements. For example, the wall engaging portion 68 can be configured to function as a reamer or a casing scraper.

The interior side of each centralizing leaves 34 is provided with a cam surface 71 as may be seen in FIG. 9B. The centralizing leaves 34 are provided with medial grooves 78 adapted to receive the bridges 77 of the leaf barrel 32 to stabilize the centralizing leaves 34 in the expanded condition.

The trip ring 81 (FIG. 10A) is retained in the annular recess 80 of the leaf barrel 32 (FIG. 8B) by the trip ring retainer 36, best shown in FIG. 11.

Referring again to FIGS. 1-1B and 2-2B, the housing assembly 20 forms a housing for the mandrel assembly 22 which is adapted for telescoping movement relative to the housing assembly 20 between a drilling position and a released position. In the drilling position, the mandrel assembly 22 is positioned to force the centralizing leaves 34 of the subassembly 11 to move to the expanded position and to transfer torque applied to the mandrel assembly 22 by a drilling rig (not shown) to the housing assembly 20 and in turn to the drill bit 18. In the released position, the mandrel assembly 22 allows the centralizing leaves 34 to move to the collapsed position, creates a jarring action (within the drill string portion 10) to the housing assembly 20 upon being released from the drilling position, is capable of rotating freely relative to the housing assembly 20, and permits fluid circulation through the drill string 12 to be uninterrupted. To facilitate these functions, the mandrel assembly 22 includes a mandrel 82, a spacer mandrel 84, a spline mandrel 86, and a stinger 88.

Figure 12C:
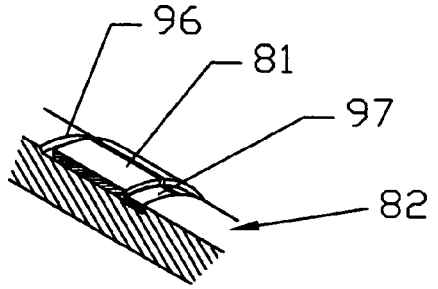
FIG. 12C is a detail view of the trip ring and anvil taken from A in FIG. 12A.
Figure 12A:
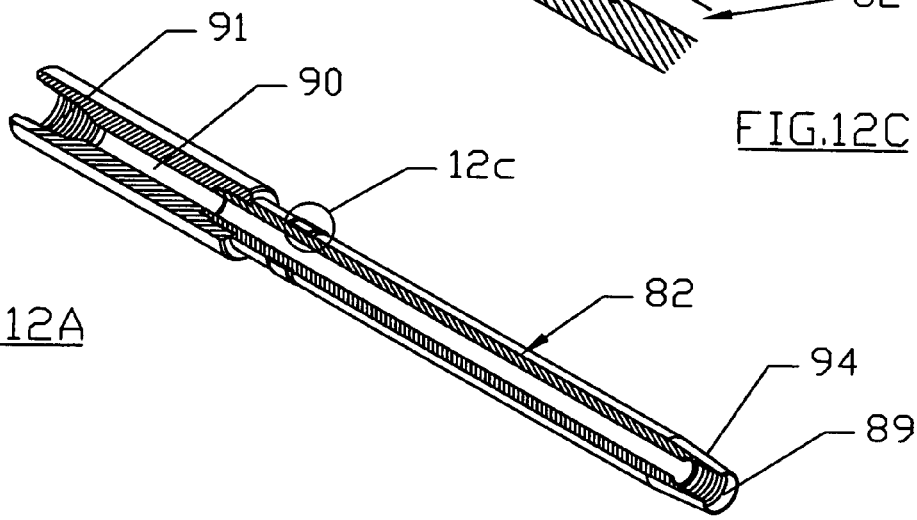
FIG. 12A is a cutaway, isometric view of a mandrel.
Figure 12B:
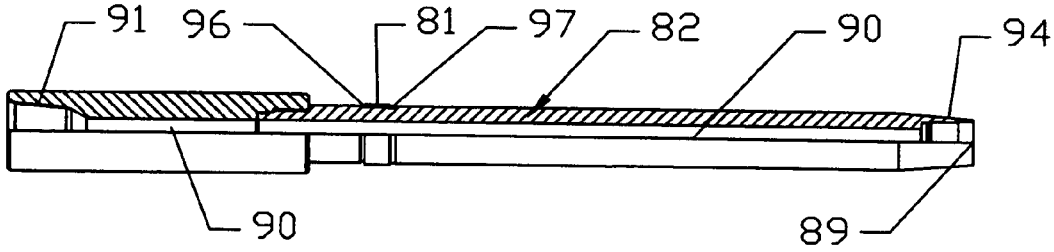
FIG. 12B is an elevational view, partially in cross section, of the mandrel.

As shown in FIGS. 12A and 12B, the mandrel 82 has an internal bore 90 extending therethrough from an upper end 83 to a lower end 89. The upper end 83 of the mandrel 82 is provided with internal threads 91 for connection with a drill collar or drill pipe. Telescopic movement of the mandrel 82 relative to the centralizing leaves 34 causes the centralizing leaves 34 to move between the expanded position and the collapsed position. To affect the movement of the centralizing leaves 34 to the expanded position, the mandrel 82 is provided with a cam surface 94 near the lower end 89 thereof. The cam surface 94 cooperates with the cam surface 71 of the centralizing leaves 34 to force the centralizing leaves 34 radially outward to the expanded position upon telescopic contraction of the mandrel 82 into the housing assembly 20. Upon telescopic expansion of the mandrel 82 from the housing assembly 20, the elasticity of the centralizing leaves 34 causes the centralizing leaves 34 to return to the collapsed position. Contact of the centralizing leaves 34 with the sidewall of the well bore 14 may assist in returning the centralizing leaves 34 to the collapsed position.

The mandrel 82 is further provided with an annular recess 96 sized to hold the trip ring 81 (FIG. 10A) so as to restrain longitudinal movement of the mandrel assembly 22 relative to the housing assembly 20 in the drilling position. The trip ring 81 is fabricated to be released from the annular recess 96 upon the application of a longitudinal pulling force on the drilling string 12 which translates into a predetermined axial force in the ring. The axial forces created in the trip ring 81 are determined by the length of the ring L; the thickness of the ring T; and, most significantly, the angle A of the trip ring edges and the angle of the shoulder 97 of the annular recess 96 of mandrel 82. As will be described in more detail below, the pulling force required to overcome the predetermined axial force to "open" the trip ring 81 may be varied to provide an indication of where the drill string 12 is stuck in the well bore hole. It should further be appreciated that other retaining members can be used in place of a trip ring. For example, the housing assembly 20 may be provided with a friction grip collet quick release device which is adapted to mate with a corresponding recess in the mandrel 82. Other friction trips or shear pins may be used, but one time trips have the disadvantage of requiring the drill string 12 to be withdrawn from the well hole. FIG. 12C illustrates the details of the trip ring mechanism noted in FIG. 12A at reference numeral 12*c*.

Figure 13:
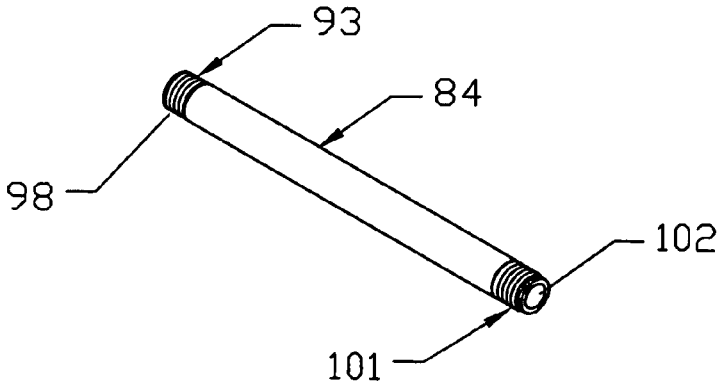
FIG. 13 is an isometric view of a spacer mandrel.

The lower end 89 of the mandrel 82 is connected to the upper end 93 of the spacer mandrel 84 (FIG. 13). The upper end of the spacer mandrel 84 is provided with a groove 98 to receive an O-ring so as to provide a fluid tight seal between the spacer mandrel 84 and the mandrel 82. The lower end 101 is also provided with an annular groove 100 or receiving an O-ring. The spacer mandrel 84 has an internal bore 102 extending from the upper end 93 to the lower end 101.

Figure 2B:
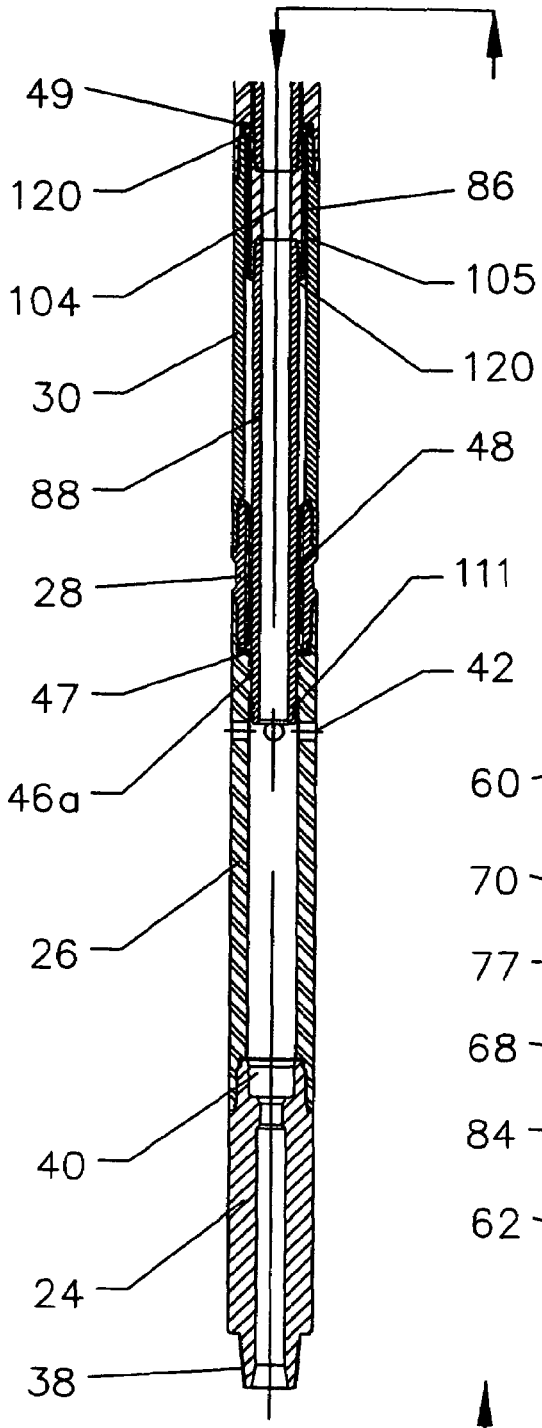
FIG. 2B shows a position of the subassembly of the present invention in the released mode from the bit crossover section to leaf barrel.
Figure 2C:
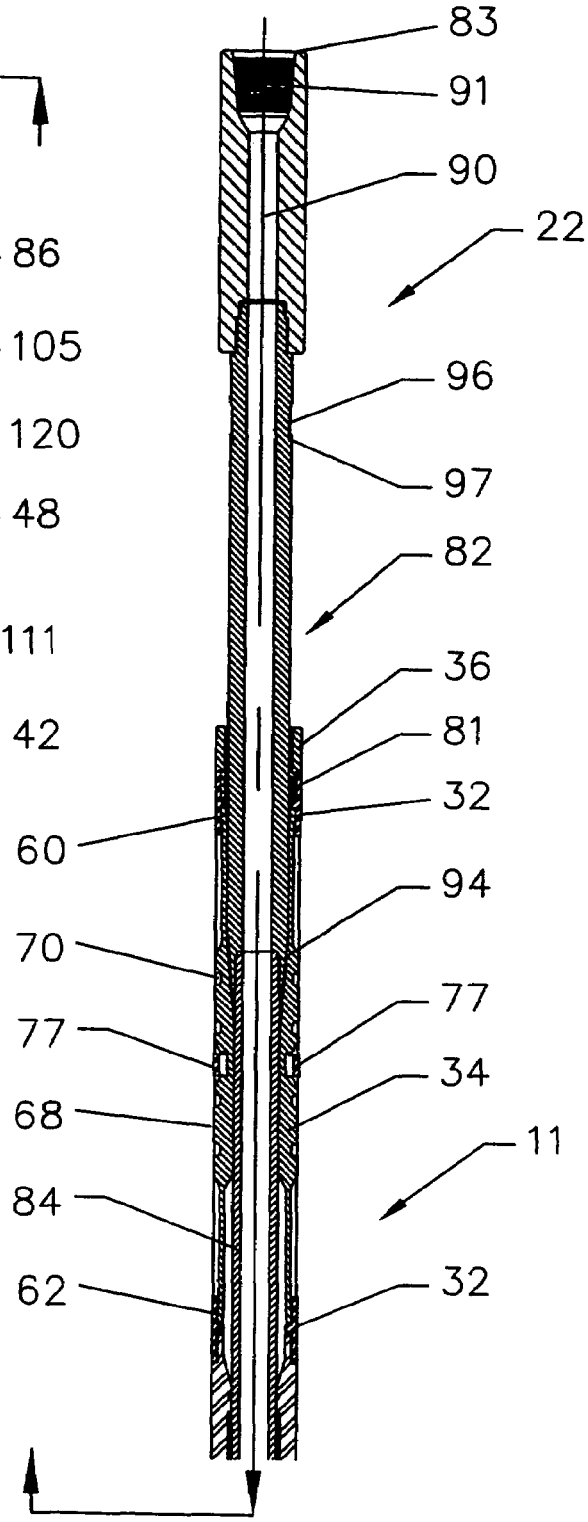
FIG. 2C shows a portion of the subassembly of the present invention in the released mode from the leaf barrel to the mandrel top sub.
Figure 14A:
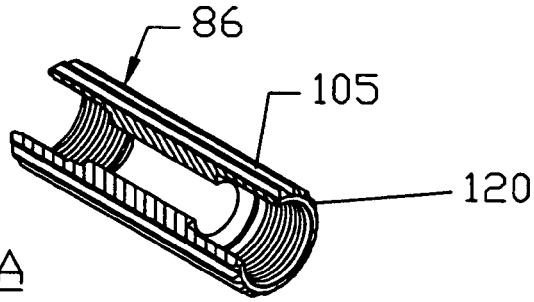
FIG. 14A is a cutaway, isometric view of a spline mandrel.
Figure 14B:
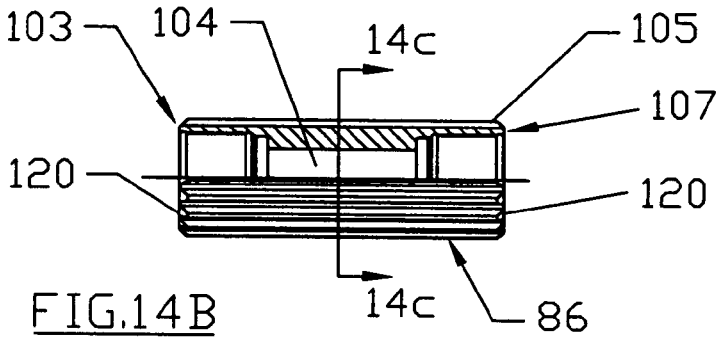
FIG. 14B is an elevational view, partially in cross section, of the spline mandrel.
Figure 14C:
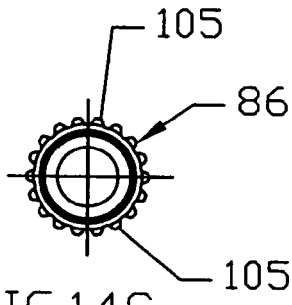
FIG. 14C is an end view of the spline mandrel taken along line 14C-14C of FIG. 14.

The lower end 101 of the spacer mandrel 84 is connected to an upper end 103 of the spline mandrel 86 (FIGS. 14A-14C). The spline mandrel 86 is provided with an internal bore 104 extending from the upper end 103 to the lower end 107 thereof. The external surface of the spline mandrel 86 is provided with a plurality of splines or teeth 105 extending longitudinally along the external surface thereof. The splines 105 are sized and shaped to mate with the splines 48 of the spline housing 28 when the subassembly 11 is in the drilling position and thereby transmit rotational torque applied to the mandrel assembly 22 to the housing assembly 20. When the subassembly 11 is moved to the released position, the spline mandrel 86 is in a non-engaging position relative to the spline housing as shown in FIGS. 2A-2B. As such, the mandrel assembly 22 is capable of being rotated relative to the housing assembly 20. If the housing assembly 20 is stuck, that portion of the drill string 12 extending above the housing assembly 20 may be rotated and hereby prevent additional portions of the drill string 12 from becoming stuck. To further facilitate rotation of the mandrel assembly 22 relative to the housing assembly 20, the housing assembly 20 may be provided with load bearings (not shown) at the upper and lower ends of the leaf barrel 32 to centralize rotation of the mandrel assembly 22 and reduce friction.

The ends 120 of the splines 105 are beveled to facilitate engagement with the spline housing 28 when the mandrel assembly 22 is moved from the released position to the drilling position. The beveled ends of the splines 105 additionally prevent damage to the splines 105 upon the mandrel assembly 22 being released from the drilling position. That is, upon the release of the mandrel assembly 22 from the drilling position as a result of a pulling force being applied sufficient to overcome the tripping force of the trip ring 81, the mandrel assembly 22 travels upwardly until the upper end 103 of the spline mandrel 86 impacts the wear ring 49 thereby producing a hammer type action within the subassembly 11 that may loosen or free the stuck drill string. The beveled ends 120 of the splines 105 also prevent damage to the splines 104 when the mandrel assembly 22 is moved to the drilling position. Upon initial engagement of the spline mandrel 86 with the spline housing 28, the drill string 12 may be lowered to cause the lower end of the spline mandrel 86 to impact the adjacent wear ring 49 and produce a downward hammer type action that may loosen or free the stuck drill string.

To further prevent damage to the spline mandrel 86, the wear rings 49 are preferably fabricated of a material that is softer than the material from which the spline mandrel 86 is fabricated. Consequently, only the wear rings 49 need be replaced after each use of the subassembly 11, rather than the spline mandrel 86.

Figure 15A:
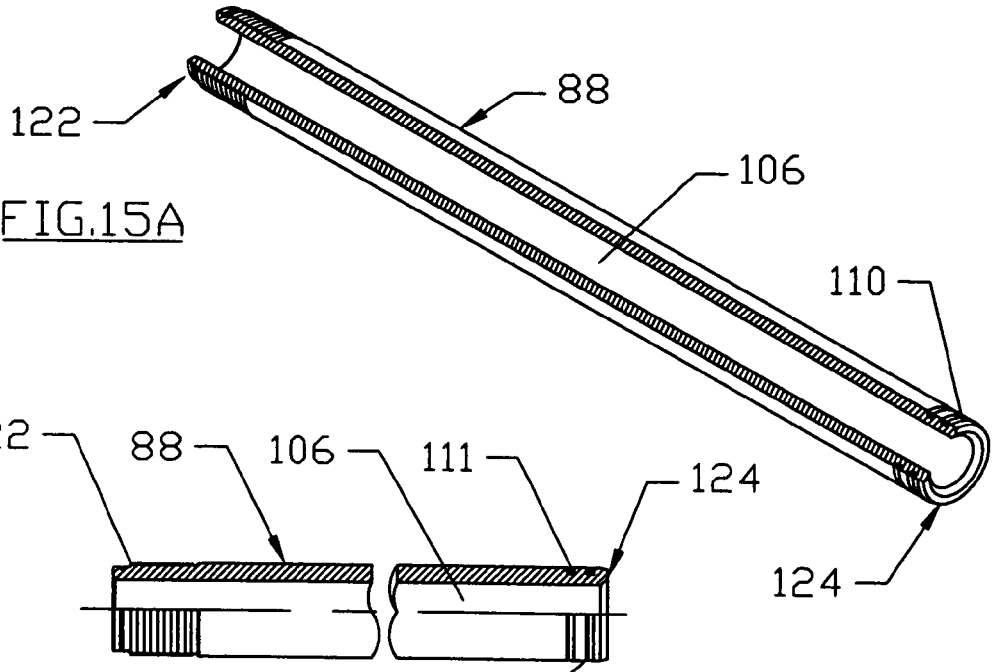
FIG. 15A is a cutaway, isometric view of a stinger.
Figure 15B:
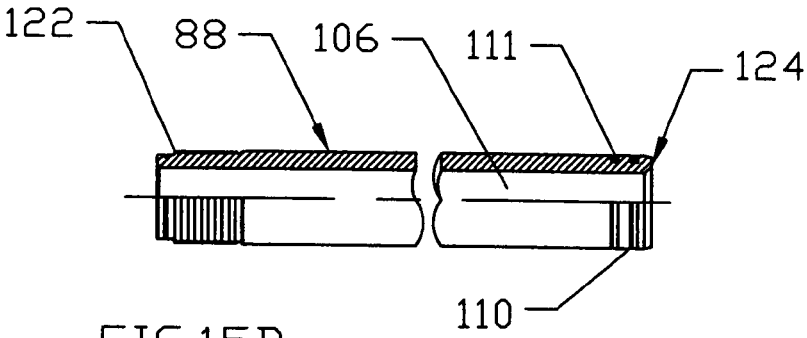
FIG. 15B is a split, elevational view, partially in cross section, of the stinger.

The lower end 107 of the spline mandrel 86 is connected to an upper end 122 of the stinger 88. The stinger 88 (FIGS. 15A and 15B) is an elongated pipe with an internal bore 106 extending from the upper end 122 to the lower end 124 thereof. The upper end 122 of the stinger 88 is provided with an annular groove 108 for receiving an O-ring so as to form a fluid tight seal between the upper end of the stinger 88 and the lower end of the spline mandrel 86. The lower end of the stinger is provided with a pair of annular grooves 110 for receiving seal members 111 (FIGS. 1 and 2) which are preferably pressure activated and which are capable of rotational sealing. The stinger 88 has a length such that the lower end 124 of the stinger 88 is positioned in the annular recess 40 of the bit crossover 24 when the subassembly 11 is in the drilling position. With the lower end of the stinger 88 positioned in the annular recess 40 of the bit crossover 24, the seal members 111 form a fluid tight seal between the stinger 88 and the bit crossover 24 thereby providing a fluid conduit extending through the mandrel assembly 22 and through the bit crossover 24 to permit circulation to the drill bit 18.

When the mandrel assembly 22 is moved to the released position, the lower end of the stinger 88 is positioned above the holes 42 of the circulating sub 26. As such, if the drill bit 18 is plugged or if a plug is inserted into the upper end of the bit crossover 24, drilling fluid is capable of being circulated through the mandrel assembly 22 and out through the holes 42 of the circulating sub 26. It should be noted that the internal diameter of the circulating sub 26 is greater than the outer diameter of the seal members 111 of the stinger 88 such that the seal members are in a non-compressed state which the mandrel assembly 22 is traveling between the drilling position and the released position. However, substantial circulation of drilling fluid to the drill bit 18 is again initiated upon the lower end of the stinger 88 being lowered below the holes 42 of the circulating sub 26.

Figure 16:
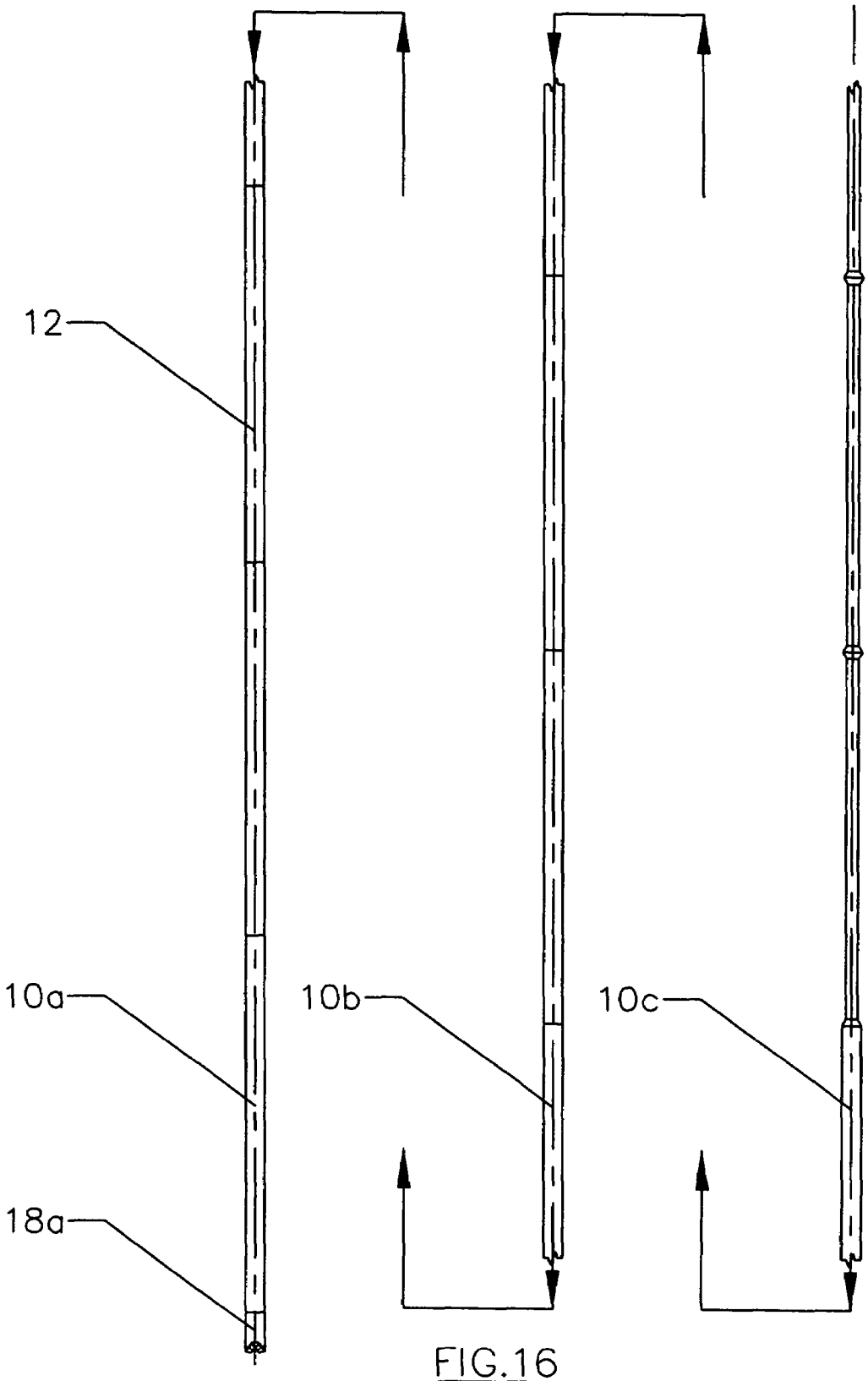
FIG. 16 is an elevational view of another embodiment of a drill string containing a plurality of stabilizers constructed in accordance with the present invention.

Referring now to FIG. 16, a drill string 12 that includes stabilizers 10*a*, 10*b*, and 10*c* is illustrated. As previously stated, the subassembly 11 maybe stabilizers 10*a*, 10*b*, and 10*c*; or, alternatively, a reamer or casing scraper. In FIG. 16, the stabilizer 10*a* is located adjacent to a drill bit 18*a* with the stabilizers 10*b* and 10*c* shown to be spaced at approximately thirty to sixty foot intervals. The stabilizers 10*a*-10*c* are each provided with a trip ring 81 which is designed to release at different preset pulling forces. For example, the stabilizer 10*a* may be provided with a trip ring designed to release upon the application of a pulling force of 20,000 pounds above drill string weight, while the trip ring of the stabilizer 10*b* is designed to release at 40,000 pounds above drill string weight, and the trip ring of the stabilizer 10*c* is designed to release at 60,000 pounds above drill string weight.

By utilizing stabilizers or any collapsing subassembly in the drill string with different trip settings, the approximate location that the drill string 12 is stuck maybe determined. If the drill string 12 becomes stuck and upon applying a pulling force of at least 20,000 pounds above drill string weight, and the stabilizer 10*a* releases, then it can be concluded that the drill string 12 is stuck at the housing assembly of the stabilizer 10*a* or lower. Likewise, if a pulling force greater than 40,000 pounds above drill string weight is required to release one of the stabilizers, then it can be concluded that the drill string 12 is stuck below the stabilizer 10*a* and the stabilizer 10*b*. Finally, if a pulling force of 60,000 pounds above drill string weight is required to release one of the stabilizers, then it can be concluded that the drill string 12 is stuck between the bit 18*a* and the stabilizer 10*c*. With the location of the sticking point identified, an appropriate treatment can be more easily designed and implemented.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

The invention claimed is:

1. A method for loosening a stuck section of a downhole drill string in a well bore hole comprising the steps of:

collapsing said stuck section by longitudinally extending the length of said stuck section thereby retracting well borehole wall engaging leaves in the stuck section to reduce the outside diameter of said stuck section;

initiating a jarring action from within said string by said longitudinally extending the length of said stuck section to collapse said stuck section.

2. The method of claim 1 wherein said stuck section includes a collapsible subassembly selected from the group consisting of a stabilizer, a reamer, and a casing scraper.

3. The method of claim 1 wherein said downhole drill string further comprises:

an upper string section;

a lower string section joined to said upper string section;

a drill bit joined to said lower string section, said upper string section adapted to rotated independently of said lower string section and said drill bit while said upper string section is suspended within the well borehole.

4. The method of claim 3 wherein said upper string section has a collapsible subassembly.

5. The method of claim 4 wherein said collapsible subassembly is selected from the group consisting of a stabilizer, a reamer, and a casing scraper.

6. The method of claim 1 further comprising circulating drill fluid from inside said drill string to outside said drill string through lateral side openings in said stuck section into said well borehole as said jarring action is initiated.

7. A collapsible downhole drill string for drilling a well borehole comprising:

an upper string section;

a lower string section joined to said upper string section;

a drill bit joined to said lower string section;

said upper string section adapted to rotate independently of said lower string section and said drill bit while said upper string section is suspended within said well borehole;

a collapsible subassembly disposed along said string comprising borehole engaging leaves inwardly retractable from a first engaged position to a second disengaged position to reduce the overall outside diameter of said collapsible subassembly, said leaves being movable from said first position to said second position upon extension of the length of the collapsible subassembly; and a means within said drill string for internally jarring said drill string upon said extension of the length of the collapsible assembly.

8. The string of claim 7 wherein said collapsible subassembly is selected from the group consisting of a stabilizer, a reamer, and a casing scraper.

9. The string of claim 7 further comprising:

a means for circulating a drilling fluid through said lower string section when said lower string section is not rotating and said upper string section is rotating.

10. The string of claim 7 further comprising a means for locating the position of a stuck subassembly along said drill string.

11. The string of claim 7 further comprising means within said drill string for circulating drill fluid from inside said drill string to outside said drill string through lateral side openings in said stuck section into said well borehole as said jarring action is initiated.

* * * * *